United States Patent [19]

Nilsson

[11] 4,396,312

[45] Aug. 2, 1983

[54] ROAD SURFACING AND METHOD FOR MANUFACTURING SUCH ROAD SURFACING

[75] Inventor: Nils-Ake Nilsson, Täby, Sweden

[73] Assignee: IFM Akustikbyran AB, Stockholm, Sweden

[21] Appl. No.: 221,677

[22] PCT Filed: May 9, 1980

[86] PCT No.: PCT/SE80/00136

§ 371 Date: Jan. 9, 1981

§ 102(e) Date: Dec. 30, 1980

[87] PCT Pub. No.: WO80/02435

PCT Pub. Date: Nov. 13, 1980

[30] Foreign Application Priority Data

May 9, 1979 [SE] Sweden ..... 7904085

[51] Int. Cl.[3] ..... E01C 3/06

[52] U.S. Cl. ..... 404/72; 106/901; 404/17; 404/19; 404/32

[58] Field of Search ..... 404/20, 17, 19, 32, 404/33, 72, 81, 82; 106/901

[56] References Cited

U.S. PATENT DOCUMENTS

| | | | |
|---|---|---|---|
| 1,779,955 | 10/1930 | Young | 404/20 |
| 2,147,362 | 2/1939 | Bloomberg | 404/32 X |
| 2,515,847 | 7/1950 | Winkler | 404/32 X |
| 2,871,774 | 2/1959 | Johnson | 404/32 X |
| 2,977,864 | 4/1961 | Pullar | 404/32 X |
| 3,253,521 | 5/1966 | Endres | 404/32 X |
| 3,272,098 | 9/1966 | Buchholtz | 404/32 |
| 3,690,227 | 9/1972 | Welty | 404/20 X |
| 3,915,581 | 10/1975 | Copp | 404/32 |

*Primary Examiner*—Nile C. Byers, Jr.

*Attorney, Agent, or Firm*—Griffin, Branigan & Butler

[57] ABSTRACT

A road surfacing (3) which emits reduced rolling noise and a method for the manufacture of such a road surfacing is disclosed. The road surfacing material is relatively soft and incorporates air-permeable, preferably intercommunicating channels or pores. In the manufacture of the surfacing, granulate or chip particles (4) are bound so that channels or pores are formed between the particles.

4 Claims, 4 Drawing Figures

ROAD SURFACING AND METHOD FOR MANUFACTURING SUCH ROAD SURFACING

BACKGROUND OF THE INVENTION

The present invention concerns a road surfacing with reduced rolling noise emission and a method for its manufacture.

A considerable environmental problem in today's society is noise emission from roads and streets. At lower speeds and high acceleration, in most cases noise from the power unit dominates at the receiver point as compared to the rolling noise. At speeds exceeding 50 km/h, however, rolling noise generated by the tire/-road contact will dominate. This means that even along streets and roads in built-up areas, a considerable part of the noise emission is caused by the tire/road noise. In such areas it would not be particularly helpful to further reduce noise emission from the power units. The fact that tire/road rolling noise aleady dominates the total noise at 50 km/h contributes to a certain understandable disinclination of car manufacturers to further reduce noise emission from the power units. Thus, a reduction of the tire/road rolling noise would solve acute noise problems for streets and highways where speeds generally exceed 50 km/h and also would reduce traffic noise even at lower speeds, since reduced tire noise levels will increase the motivation to also reduce the noise emission of the power unit.

Tire/road noise is generated by the contact between the tire and the road surface. The major part of the sound radiation occurs from the tire close to the contact patch. For tires with more powerful tread patterns this takes place from the trailing portion of the contact patch. At lower frequencies (below about 800 Hz), tire/road noise is dominated by direct radiation of the tire carcass vibrations. At higher frequencies, air-resonances between tire and road surface will probably substantially influence noise radiation. This means that a considerable noise reduction could be achieved if such air-resonances are not excited to a greater extent. To achieve this it is very important that air pressure neutralization between tread pattern cavities occur.

Methods known up to now for tire/road noise reduction are:

1. Measures on tread pattern, i.e. distributing the length of tread blocks in direction of rotation so that tonal components are spread around the mean frequency, thereby reducing tonal peaks;
2. Changing the rubber compound so that higher compliance is obtained; and,
3. Influencing the road surface texture so that an optimum texture depth with regard to tire noise is obtained.

Further developing these constructional principles could give 2–4 dB(A) in additional noise reduction. Laboratory studies have revealed that the most probable cause of the high frequency noise production from tires (most important for the perceived noise impression) is that tire tread block oscillations cause air movements. If the positive and negative pressures, respectively, which are created in the tire grooves could be equalized, the noise would decrease.

SUMMARY OF THE INVENTION

One way of obtaining such equalization is, according to the present invention, to make the road surface porous. This can be done e.g. by binding a granulate of homogenous grain size by a suitable amount of binder to achieve the porosity. Porosity could also be produced by creating air-permeable channels in other ways, e.g. by drilling or otherwise making holes at production of a road surfacing. An additional positive effect of the porosity is that such road surfaces have considerably better sound absorption abilities, particularly in high frequency range, than do ordinary non-porous road surface. This is of vital interest since the sound generation mainly occurs extremely close to the road surface. As a great portion of the tire/road noise then will propagate close to the road surface, the paving will greatly absorb noise.

Porosity will also promote drainage of water film from a wet road surface, thus reducing the noise level as well as lowering the risk of hydroplaning.

As mentioned, tire vibrations start air-resonant oscillations in the contact region and produce the major part of the high frequency noise. By reducing these vibrations in the tire, the radiated noise is also reduced. One way of reducing tire vibrations would be to construct the road surface so that a substantial increase in its compliance is obtained. If, however, the road surface is given only increased compliance, the noise will increase due to a greater compression pressure being built up when the tire contacts the road surface. If, on the other hand, according to the invention, the higher compliance is combined with porosity of the road surface, the air pressure differences will be neutralized and a significantly reduced noise level in the far field will be obtained as compared either to a hard and porous surface or to a soft and dense road surface.

An additional beneficial consequence of making the road surface simultaneously soft and porous is that the tire to some extent sinks down into the road surface. This means that the tire tread release angles will be smaller, which is favorable with respect to noise radiation. This "down sinking" is furthermore an advantage with respect to road holding (e.g. panic brakings). It will further cause breaking up of ice layers on the surface.

The soft road surface furthermore causes less tire vibrations to be transferred to the vehicle cabin and, thus, greater driving comfort.

Considerably less tire wear results when driving cars with studded tires on a road surface having substantially increased compliance in combination with porosity, as contrasted with usual asphalt surfaces. Due to the fact that the studs sink into the rubber and flex, parts of the surface will not be torn away when the studs contact the road surface. This was also confirmed in laboratory tests where a studded tire was run on a rubber surface of the kind stated for about two hours without any measurable wear being noticed. A corresponding test on an ordinary asphalt surface caused remarkable tire wear (in the range of 1–2 mm). Furthermore, there is no noticeable increase of noise when driving with studded tires on a porous rubber surface in contrast to driving on an ordinary road surface.

The laboratory tests reveal that the compliant/porous surface gives about 10 dB units lower noise in the high frequency region when compared to a standard asphalt surface of type AEB12T (the Swedish notation). A considerable decrease was also found in the tonal components of the tire noise spectra.

A number of alternative methods of manufacturing a porous road surface are possible. For instance, granulated waste rubber (e.g. from scrap tires) could be screened to a uniform grain size and bound by polyurethane rubber. Other possible binders are latex, emulsified solutions of synthetic rubber, etc. It would also be possible to granulate unvulcanized rubber and to heat the rubber to vulcanization temperature in connection with pressure, thereby achieving a complete granulate product without binder. In connection with such pressing process, any kind of pattern could also be applied in the surface layer for improved road holding capability.

BRIEF DESCRIPTION OF THE DRAWINGS

The invention will be further described with reference to the annexed drawings, wherein.

DETAILED DESCRIPTION OF THE DRAWINGS

Figure 1:
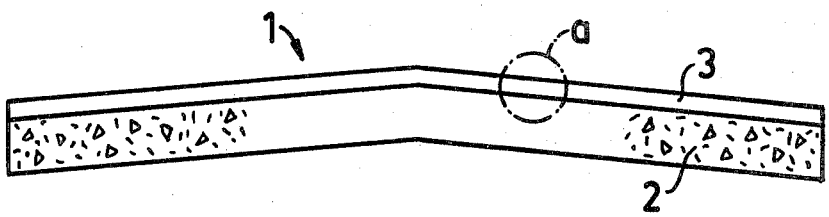
FIG. 1 shows a cross section through a road structure.
Figure 1A:
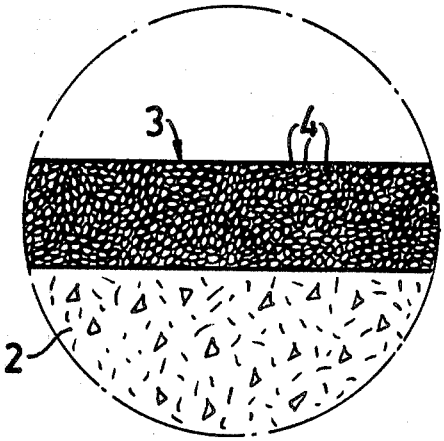
FIG. 1*a* shows an enlargement of the encircled portion a of FIG. 1.

In the embodiment of FIGS. 1 and 1*a*, a road 1 is shown comprising a substratum 2 of concrete or the like and a road surfacing 3 consisting of a multiplicity of vulcanized or otherwise interconnected balls or chips 4 of rubber, plastic, or other polymeric material between which exist communicating spaces, which together form air-permeable channels or pores. Communication exists between the spaces to such an extent that air pressure equalization can take place between the different grooves of the tread surface. The road surface according to the present invention has a Youngs modulus of maximum 7 MPa as measured on a solid non-porous test body. For a normal asphalt surface, Youngs Modulus is considerably higher. The relaxation time for the material used in the road surface of the present invention is about ten times shorter than the corresponding relaxation time for an asphalt surfacing. The specific flow resistance is less than $200 \cdot 10^3$ MKS Rayls/m. The typical value for the flow resistance is around $10 \cdot 10^3$ MKS Rayls/m ($Ns/m^4$).

An additional advantage of the road surfacing of the invention is that it is possible to make a road surfacing having approximately the same material characteristics as those of the tire rubber. Accordingly, a mechanical impedance counted from the road surface and downwards is obtained that is approximately equal to the impedance from the boundary of the road surface and upwards toward the tire. This equality in mechanical impedance results in a great power transfer between the tire and the road surface. This will give the following advantages:

1. A greater mechanical power is transferred from the wheel to the road surface. This results in improved road holding characteristics.
2. A part of the tire vibrations are transferred to the road surface where the radiation damping is greater. Thus, vibrations in the road surfacing give rise to lower sound pressure levels in the far field than corresponding vibrations in the tire structure.

The particles used in the road surfacing of the present invention are bound together by a binder which has characteristics (such as Youngs Modulus and relaxation time) which do not deviate from the corresponding characteristics of the particles by a factor of $5^{\pm 1}$.

The asphalt forming an ingredient of the asphalt road surfacing AEB12T (mentioned above) is of a type notified as A 120 according to the building code of the National Swedish Road Administration and has a penetration of 200–250 measured according to ASTM D 5/73.

Figure 2:
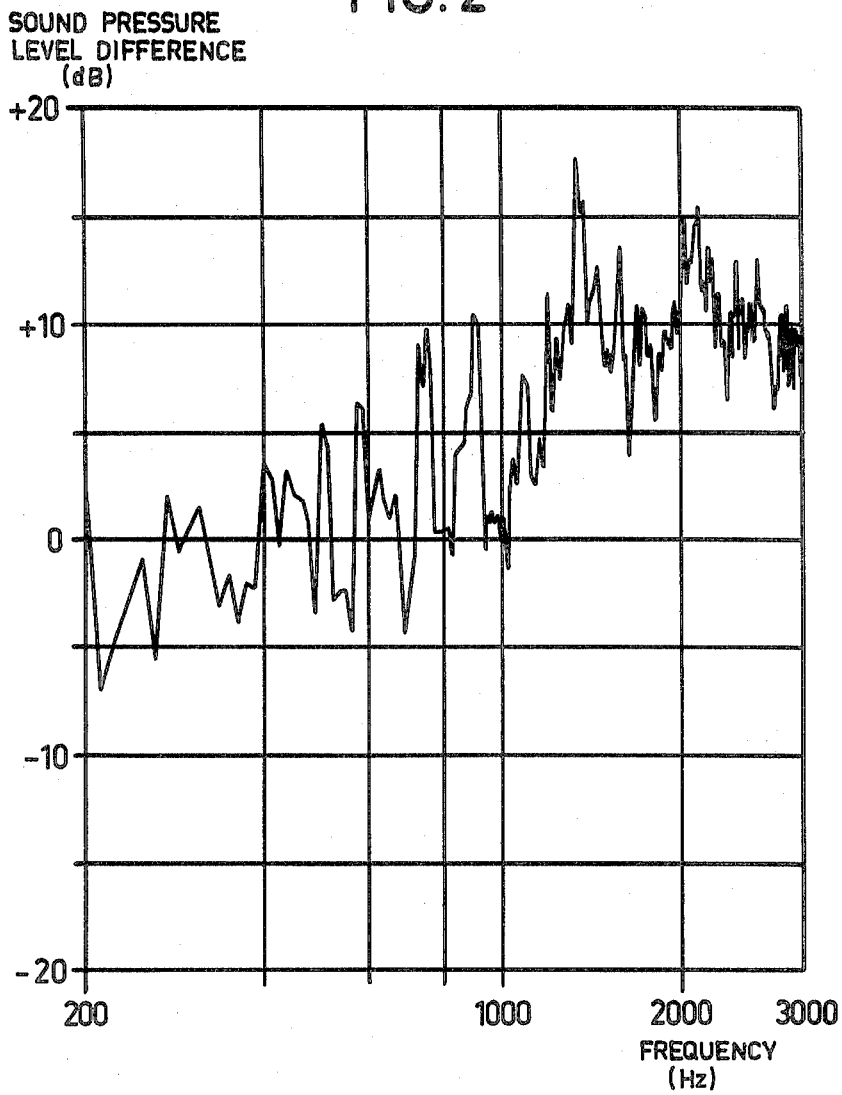
FIG. 2 is a diagram showing a reduction spectrum (difference spectrum) at different frequencies for a porous and soft rubber surfacing according to the invention relative to a conventional asphalt surfacing; and, FIG. 3 is a diagram showing the sound pressure levels for asphalt and rubber, respectively, at different frequencies.

FIG. 2 shows a difference spectrum at different frequencies for a surfacing according to the present invention in relation to an asphalt surfacing of the above-mentioned type.

Figure 3:
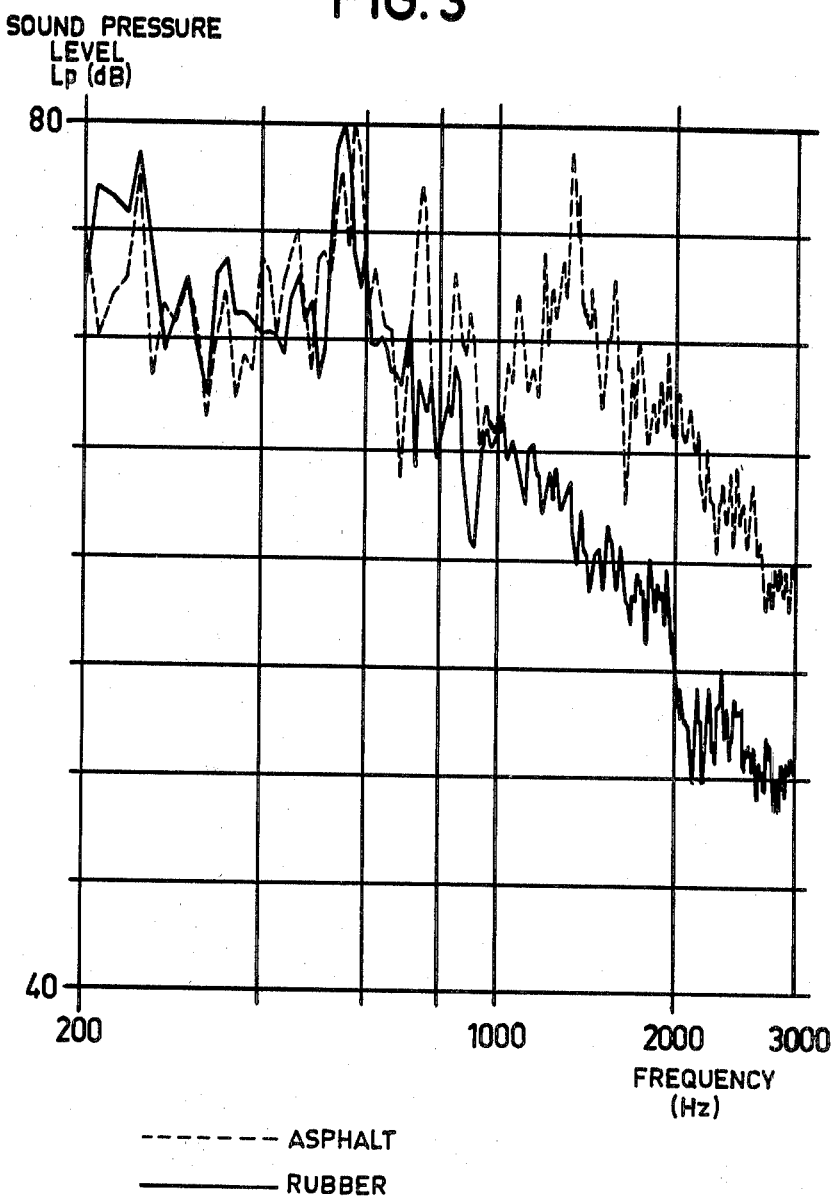

FIG. 3 shows sound pressure levels at different frequencies for a surfacing according to the invention and a conventional asphalt surfacing, respectively. There is a difference of 8 dB(A) between 1000 and 3200 Hz and a difference of 5.2 dB between 200 and 1000 Hz. This latter, lower difference is probably dependent on the influence from background sound levels.

I claim:

1. Road surfacing comprising polymeric particles bound together by a binder but having intercommunicating airpermeable spaces therebetween, said bound particles forming a porous road surface having (1) a material Youngs Modulus in compression and tension not exceeding 7 MPa; and, (2) a flow resistance therethrough not greater than $200 \cdot 10^3$ MKS Rayls/m, said binder having a Youngs Modulus and a relaxation time which do not deviate from the Youngs Modulus and relaxation time of said particles by more than a factor of 5 raised to the $\pm 1$ power.

2. The road surfacing of claim 1 wherein said road surface further has a relaxation time on the order of one tenth of the relaxation time of an asphalt, said asphalt having a penetration in the range of 200 to 500 as measured according to ASTM D5/73.

3. The road surfacing of claim 1 wherein said air-permeable spaces between said particles communicate in a longitudinal direction of said road.

4. A method of making a road surfacing material comprising the steps of:

granulating polymeric particles;

binding said polymeric particles together with a binder so that intercommunicating, air-permeable spaces are formed between said particles, thereby forming road surfacing material having (1) a material Youngs Modulus in compression and tension not exceeding 7 MPa, and (2) a flow resistance therethrough not greater than $200 \cdot 10^3$ MKS Rayls/m, said binder having a Youngs Modulus and a relaxation time which do not deviate from the Youngs Modulus and relaxation time of said particles by more than a factor of 5 raised to the $\pm$ power.

* * * * *